US005778653A

United States Patent [19]

Stahlecker

[11] Patent Number: 5,778,653

[45] Date of Patent: Jul. 14, 1998

[54] SUCTION ROLLER FOR AN OPEN-END SPINNING MACHINE

[75] Inventor: Fritz Stahlecker, Josef-Neidhart-Strasse 18, 73337 Bad Überkingen, Germany

[73] Assignees: Fritz Stahlecker, Bad Uberkingen; Hans Stahlecker, Sussen, both of Germany

[21] Appl. No.: 802,350

[22] Filed: Feb. 11, 1997

[30] Foreign Application Priority Data

Mar. 7, 1996 [DE] Germany ..... 196 08 829.1

[51] Int. Cl.[6] ..... D01H 4/00

[52] U.S. Cl. ..... 57/401; 57/403; 57/411

[58] Field of Search ..... 57/401, 403, 411, 57/413, 252

[56] References Cited

U.S. PATENT DOCUMENTS

| | | | |
|---|---|---|---|
| 4,281,507 | 8/1981 | Didet et al. | 57/401 |
| 4,653,264 | 3/1987 | Stahlecker et al. | 57/401 |
| 4,727,716 | 3/1988 | Billner | 57/401 |
| 4,738,097 | 4/1988 | Brockmanns et al. | 57/413 X |
| 4,759,176 | 7/1988 | Stahlecker | 57/401 |
| 4,760,963 | 8/1988 | Billner | 57/401 |
| 4,819,420 | 4/1989 | Lovas et al. | 57/401 X |

FOREIGN PATENT DOCUMENTS

| | | | |
|---|---|---|---|
| 52412 | 5/1982 | European Pat. Off. | 57/401 |
| 3402368 | 8/1985 | Germany | 57/401 |
| 3424701A1 | 2/1986 | Germany . | |
| 4239696 | 6/1994 | Germany | 57/401 |
| 3196724 | 8/1988 | Japan | 57/401 |
| 3119120 | 5/1991 | Japan | 57/401 |
| 3-152223 | 6/1996 | Japan . | |
| 2240345 | 7/1991 | United Kingdom | 57/401 |

*Primary Examiner*—William Stryjewski
*Attorney, Agent, or Firm*—Evenson McKeown Edwards & Lenahan, PLLC

[57] ABSTRACT

In the case of an open-end spinning machine, a suction roller is provided which serves to transport a fiber veil, expanding transversely to the circumferential direction of the suction roller, to a yarn formation line. The length of the transport path and the width of the fiber veil are determined by defining edges of a suction insert located inside the suction roller. At least one of the defining edges extends at least along a section of the transport path at an acute angle to the circumferential direction. Thus the fiber veil is widened in comparison to the sliver-shaped fed fiber material and/or the fiber tip at the beginning of the yarn formation line is shortened.

22 Claims, 7 Drawing Sheets

SUCTION ROLLER FOR AN OPEN-END SPINNING MACHINE

BACKGROUND AND SUMMARY OF THE INVENTION

The present invention relates to a suction roller for an open-end spinning machine for transporting a fiber veil, expanding transversely to the circumferential direction of the suction roller, along a transport path to a yarn formation line disposed transversely to the circumferential direction and leading to a yarn withdrawal unit, whereby the length of the transport path and the width of the fiber veil are defined by defining edges of a suction area.

In a case of prior art of this kind (Japanese published patent application 3-152223), nothing is described concerning the arrangement of the defining edges of the suction area. From the drawings, it must be presumed that the fiber veil is transported to the yarn formation line at a constant width and exactly in the circumferential direction.

In the case of known suction rollers, problems can arise when these are applied to an open-end spinning machine as described in pending U.S. application serial number (not assigned) filed on Dec. 24, 1996 based on German patent application 196 01 038.1. According to this concept, the single fibers to be spun into a yarn at no point slow down between the stages of fed fiber material to withdrawn yarn, but rather are continuously accelerated. This means that the suction roller must have a greater circumferential speed than the arrival speed of the single fibers at the suction roller, and further that the withdrawal speed along the yarn formation line must be greater than the circumferential speed of the suction roller. This presumes that the fiber veil transported by the suction roller comprises as many or more single fibers than are required for the cross section of the finished yarn. Because of the creation of the open end of the fiber material, essential for the spinning process, the fiber veil must have a minimum width in order that a sufficiently open fiber formation arises. It is, however, not always possible to feed the sliver-shaped fiber material in the same desired width.

When a particularly wide fiber veil is being transported to the yarn formation line, a further problem arises, which is that the fiber tip which occurs on the yarn formation line "breathes", which is described in principle—albeit in connection with a different spinning process—in German-published patent application DE 34 24 708. The so-called breathing of the fiber tip arises in that the fiber tip is continuously withdrawn towards one side, while the single fibers are fed to the area of the fiber tip in an irregular sequence. It can happen that in the direct area of the fiber tip, too few single fibers are available, so that the farthest fibers lose contact with the fiber tip and are not taken along.

It is an object of the present invention to provide an arrangement where the fiber veil, transported by the suction roller, is able to meet the respective requirements at every point of the spinning process.

This object has been achieved in accordance with the present invention in that at least one of the defining edges, which defines the width of the fiber veil, extends at least along a section of the transport path at an acute angle to the circumferential direction.

Because one of the defining edges deviates from the actual circumferential direction of the suction roller, the width and/or the relative position of the fiber veil as well as the transport direction of the single fibers can be influenced on their path to the yarn formation line.

For example, the distance between the defining edges, which define the width of the fiber veil, is extended at least along a section of the transport path. The width of fiber material, fed in the form of at least one sliver, can thus be increased while being transported on the suction roller, so that the lateral open fiber formation necessary for open-end spinning arises. This embodiment is particularly advantageous when relatively narrow, coarse slivers are fed to the spinning machine.

Alternatively or in addition, the defining edge, which defines the width of the fiber veil on the side facing away from the yarn withdrawal unit, extends in the area of the yarn formation line at an acute angle to the circumferential direction with the aim of shortening the yarn formation line. In this embodiment, the fiber tip is "tightened up" to a certain extent, and thus therefore shortened, so hat a somewhat blunt fiber tip arises, which does not so easily lose contact with the forming, withdrawn yarn.

It is particularly practical according to certain preferred embodiments to have an arrangement wherein the suction area between the defining edges, which define the width of the fiber veil, is divided by air guiding ridges. This results on the one hand in an improved lateral separation of the single fibers from one another on their transport path, and on the other hand in the single fibers being oriented in the desired direction on the circumferential surface of the suction roller. The angle of inclination of the air guiding ridges can vary over the width of the fiber veil.

In a further embodiment, the suction area along the yarn formation line is longer than the width of the fiber veil. Thus the fact that the yarn formation line is suctioned outside of the actual fiber veil for the purpose of imparting a twist is taken into consideration.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
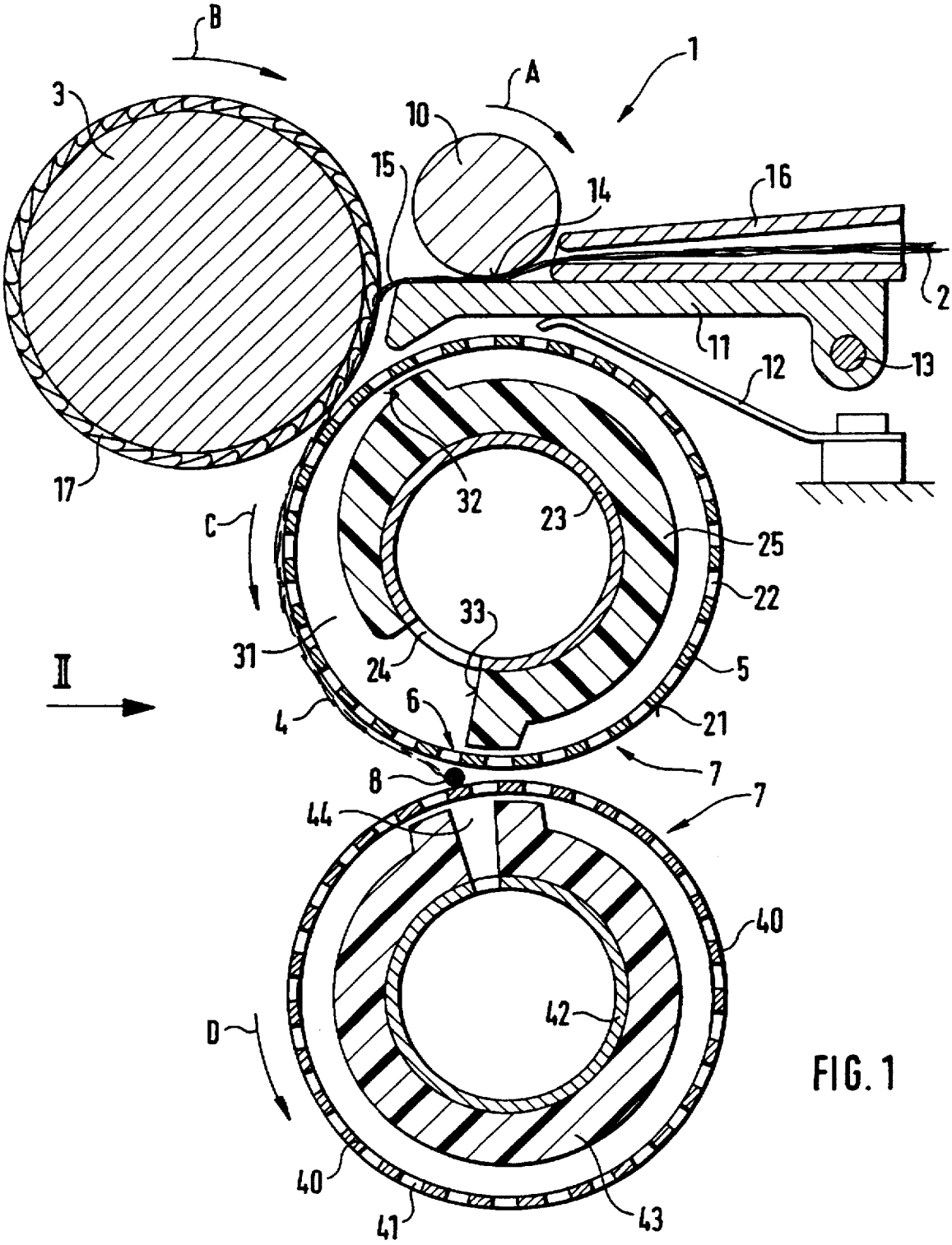
FIG. 1 is a schematic sectional side view of an open-end spinning device, which comprises a suction roller according to the present invention.
Figure 2:
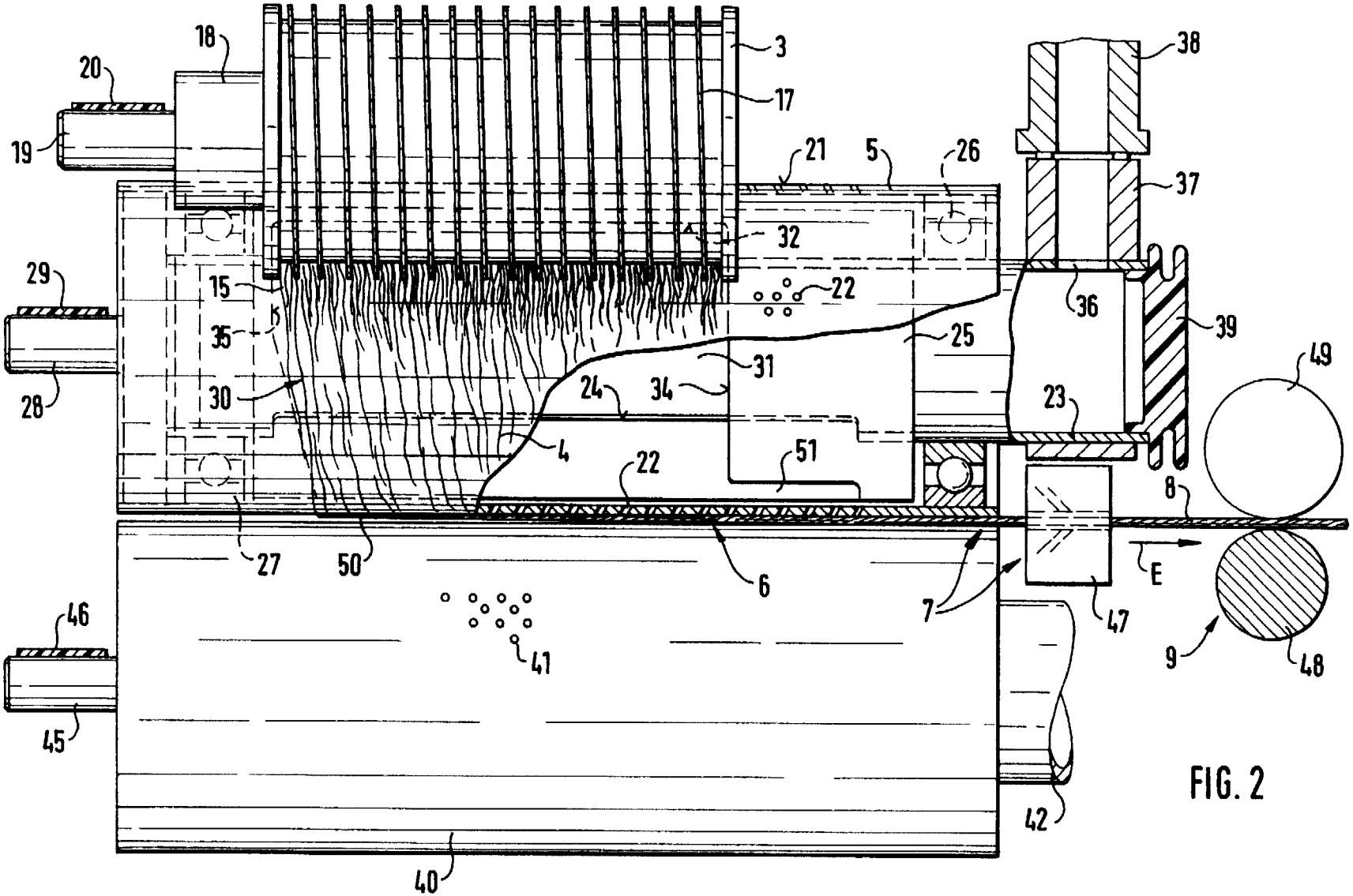
FIG. 2 is a view taken in arrow direction II of FIG. 1.

The device for open-end spinning according to FIGS. 1 and 2 comprises a feed device 1 for feeding a sliver 2 or a plurality of adjacently arranged slivers 2, an opening roller 3 for opening the single fibers 4 from the sliver 2, a suction roller 5 for transporting the single fibers 4 to a yarn formation line 6, a twist device 7 for spinning in a yarn 8 as well as a yarn withdrawal device 9 which delivers the yarn 8 to a winding device (not shown).

The feed device 1 comprises a feed roller 10 driven in rotational direction A, which acts together with a feed table 11 which can be swivelled around a swivel axle 13 and which is pressed against the feed roller 10 by means of a weighting spring 12. The feed roller 10 forms a nipping point 14 with the feed table 11, downstream of which nipping point 14 the sliver 2 forms a so-called fiber beard 15 which is fed to the opening roller 3. A feed condenser 16 for said at least one sliver 2 is arranged upstream of the nipping point 14.

The opening roller 3, driven in the same rotational direction B as the feed roller 10, but however at a significantly higher speed, comprises a saw-tooth or needle-like combing means 17, whose effective width is adapted to the width of the at least one sliver 2. The opening roller 3 is supported in a bearing housing 18 by a shaft (not shown). The shaft is provided with a drive wharve 19 at the end of the bearing housing 18 facing away from the opening roller 3, which drive wharve 19 is driven by a drive belt 20.

The suction roller 5, disposed closely adjacent to the opening roller 3 in the area of the fiber beard 15, is driven in the opposite direction to the opening roller 3 in circumferential direction C, and at a circumferential speed which is somewhat higher than the arrival speed of the single fibers 4 at the circumferential surface 21 of the suction roller 5. The circumferential surface 21 is air-permeable, and is suctioned from within. For this purpose, suction bore holes 22 are provided on the circumferential surface 21, which suction bore holes 22 have a slight incline towards the yarn withdrawal device 9, as shown in FIG. 2. It is practical when these suction bore holes 22 are aligned with the withdrawal direction E of the yarn 8.

The suction roller 5 is supported on a suction tube 23, which exposes a suction opening 24, which faces that area along which the single fibers 4 are transported on the circumferential surface 21. The transport path is defined by the suction insert 25, which is arranged on the suction tube 23 and is adjustable.

The suction tube 23 has a diameter which leaves enough space Moor the bearings 26 and 27 located on the two end areas of the suction roller 5. The suction insert 25 itself can have an outer diameter which is significantly smaller than the inner circumferential surface 21 of the suction roller 5. It is sufficient when the suction insert 25 is guided only to those places on the inner circumference of the sleeve which border the actual suction area 31.

The suction roller 5 is provided with a drive wharve 28, which is driven similarly to the way the opening roller 3 is driven by a driving belt 29.

The single fibers 4 combed from the fiber beard 15 are spread out on the circumferential surface 21 transversely to the circumferential direction C of the suction roller 5 in the form of a fiber veil 30. The contours of the suction area 31 determine, in addition to the length of the transport path, also the respective width of the fiber veil 30. The suction area 31 is provided for this purpose with defining edges 32, 33, 34 and 35, which are an essential feature of the present invention and which are described in detail in the following Figures. At this point let it be said that the defining edges 32 and 33, which extend in axial direction of the suction roller 5, determine the transport path and the defining edges 34 and 35 determine the width of the fiber veil 30.

The suction roller 5 serves to take up the single fibers 4 combed by the opening roller 3 directly after they have been opened and to guide them with a sufficiently wide fiber veil 30 at a controlled speed, without the single fibers 4 being crinkled, to the yarn formation line 6. The yarn formation line 6 extends also transversely to the circumferential direction C of the suction roller 5 and leads to the yarn withdrawal device 9.

The suction tube 23 is somewhat longer than the actual sleeve of the suction roller 5, and a small part of it projects in longitudinal direction out of the suction roller 5. In this area a cross hole 36 is provided in the suction tube 23, and in the area of the cross hole 36 the suction tube 23 is held in a clamping holder 37. The suction tube 23 is connected by the cross hole 36 to a vacuum supply 38. The suction tube 23 is sealed in longitudinal direction by a sealing piece 39.

At the end of the suction area 31 a friction roller 40 is disposed in close proximity to the suction roller 5, to that the friction roller 40 forms a wedge-shaped gap without contact in the area of the yarn formation line 6, in which gap the yarn 8 is formed. The friction roller 40 is provided also with suction bore holes 41 on its circumferential surface; The friction roller 40 is supported on a suction tube 42, which supports a suction insert 43, which faces the area of the yarn formation line 6 with a suction slit 44. In a similar way to the suction roller 5, the friction roller 40 is provided with a drive wharve 45, which is driven by a drive belt 46. The rotational direction D of the friction roller 40 is the same direction as the circumferential direction C of the suction roller 5, with essentially the same speeds.

The yarn formation line 6 is mainly determined by the lengths of the suction roller 5 and the friction roller 40. In extension of this yarn formation line 6 an air nozzle 47 is provided between the suction roller 5 and the withdrawal device 9, which air nozzle 47 imparts proper twist to the yarn 8. By means of the suction roller 5 in connection with the friction roller 40, only a loose pre-twist is generated, while the actual twist is effected by the air nozzle 47. The air nozzle 47 is similarly constructed as is known in pneumatic false-twist spinning.

The yarn withdrawal device 9 comprises in a known manner a bottom cylinder 48 driven in withdrawal direction E as well as a top roller 49 disposed thereon.

The described device for open-end spinning operates in such a way that the single fibers 4, from the sliver stage 2 to spun yarn 8, are at no time slowed down, but are rather, in the ideal case, even continuously accelerated somewhat. This acceleration is only so much that the withdrawal speed of the yarn 8 by the yarn withdrawal device 9 remains controllable. This means in particular that the single fibers 4 opened by the opening roller 3 are taken up by the suction roller 5 before the single fibers 4 have reached an excessive acceleration speed. A lateral open yarn formation should arise on the suction roller 5, which comprises the same amount or more single fibers 4 as the yarn 8. During spinning in, there is an axial staggering of the single fibers 4 on the yarn formation line 6 arranged transversely to the circumferential direction C. Any drafting errors which may arise during opening are hereby compensated for. Due to this, a somewhat stronger twist arises in the center of the yarn 8, and a somewhat weaker twist on the outside thereof. The respective twist strengths in the center and on the outside of the yarn 8 are predetermined by the width of the fed sliver 2.

If the fiber veil 30 is very wide, there is a risk that the fiber tip 50 detaches itself partly from the forming yarn 8. Here it must be presumed that the single fibers 4 do not arrive continuously at the yarn formation line, so that breaks in feeding arise at regular intervals, even when these intervals are extremely short. As the yarn 8 is continuously withdrawn in withdrawal direction E, namely at a speed which is somewhat higher than the circumferential speed of the suction roller 5, a fiber piece arises which tapers into a tip, namely the fiber tip 50. By means of the withdrawal process, the fiber tip 50 reaches, in the finished yarn 8, the center of the fiber cross section, while a new fiber tip 50 forms. There is a risk that the outermost fibers detach themselves and lose contact with the fiber tip 50, that is, they are then not withdrawn. This risk is in particular great when the fiber veil 30 is particularly wide and thinned-out. For this reason, in a way which is described in more detail below according to the present invention, the lateral defining edge 35 adjacent to the fiber tip 50 extends somewhat inclined towards circumferential direction C, for the purpose of shortening the fiber tip 50, which can be seen in FIG. 2. Thus it is ensured that the actual fiber tip 50 always comprises a sufficient amount of single fibers 4 so that it cannot lose contact with the withdrawn yarn 8. This "tightening up" of the fiber tip 50 is, however, only one of many aspects of the present invention.

As can be seen in FIG. 2, the suction area 31 is extended directly at the yarn formation line 6 in withdrawal direction E in comparison to the width of the fiber veil 30, so that here an extended suction area 51 arises. This extended suction area 51 serves to improve the twist imparted by the twist device 7, which in its entirety consists of the suction roller 5, the friction roller 40 and the air nozzle 47.

In the Figures to be described below, the same reference numbers are used as above, insofar as components with the same function are concerned. A repeat description is therefore omitted and reference will be made instead to the description of FIGS. 1 and 2.

Figure 3:
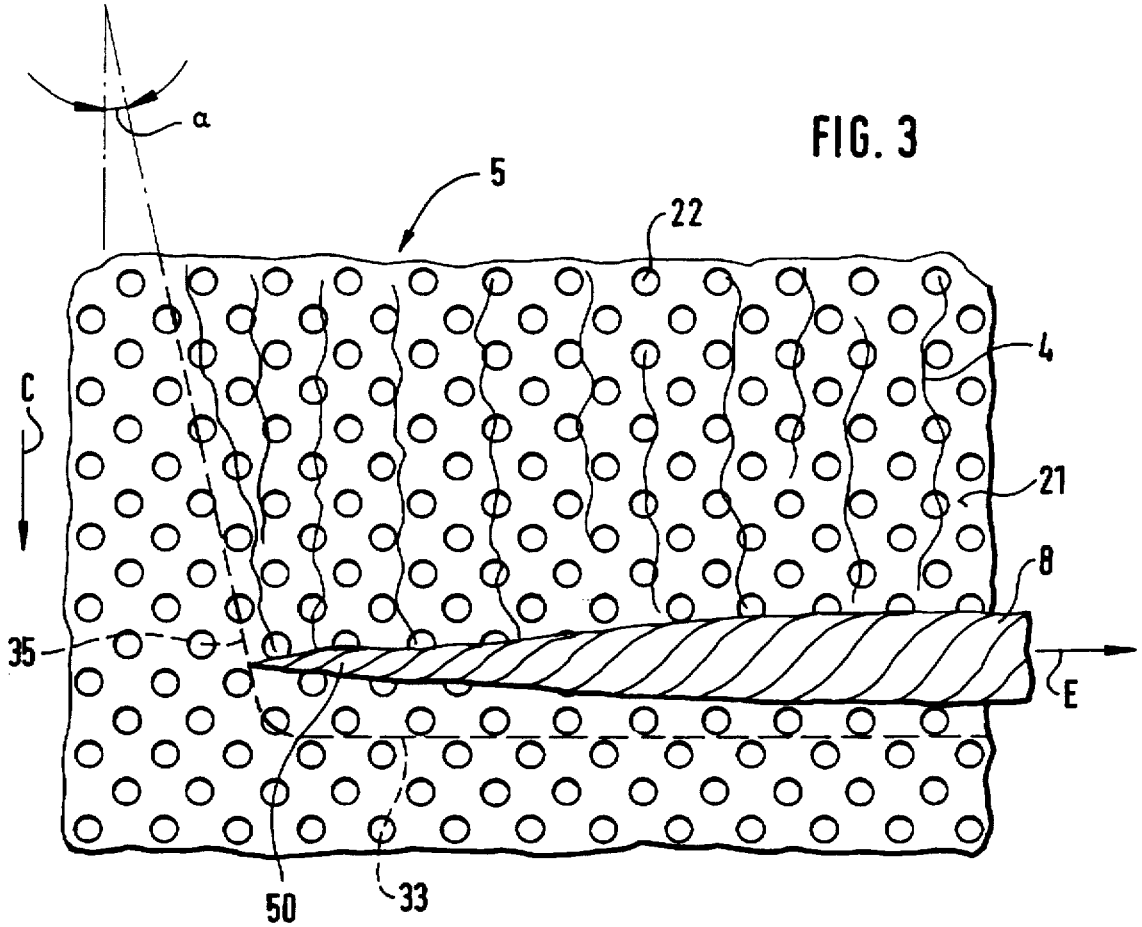
FIG. 3 is a schematic partial view in greatly enlarged dimensions of the circumferential surface of the suction roller to demonstrate the forming yarn tip.

One aspect of the present invention will be described with the aid of the greatly enlarged drawing in FIG. 3, which shows a partial view of the circumferential surface 21 of the suction roller 5. A plurality of single fibers 4, which are transported to the area of the fiber tip 50 of the yarn 8 which is withdrawn in withdrawal direction E, are identifiable. Further identified are the suction bore holes 22 and the defining edges 33 and 35 of the suction area 31 located in the inside of the suction roller 5. The defining edge 33 borders the suction area 31 parallel to the transport direction, namely in the area of the yarn formation line 6, and the defining edge 35 borders laterally, namely on the side facing the fiber tip 50, the width of the fiber veil 30.

As can be seen, the defining edge 35 extends in the end area of the transport path at an acute angle $\alpha$ towards the circumferential direction C. The defining edge 35 results in a shortening of the fiber tip 50, or expressed another way, the defining edge 35 extends so that the actual fiber tip 50 comprises more single fibers 4 then in she case of a zero angle $\alpha$.

The directional change of the single fibers 4 arriving at the fiber tin 50 is effected in that the circumferential surface 21 loses its frictional adhesion because of cessation of suction. The fiber veil 30 is thus "tightened" as described above, with the aim of blunting the fiber tip 50 somewhat.

Figure 4:
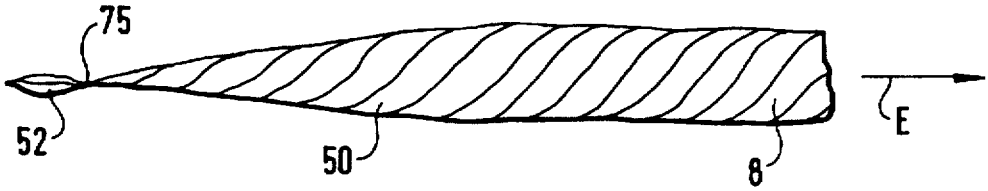
FIG. 4 is a schematic view showing a faulty yarn tip with greatly enlarged dimensions.

In contrast, FIG. 4 shows a faulty fiber tip 50, as it would arise if the value of the angle $\alpha$ of the defining edge 35 was zero. A thinning out 75 could then arise at the fiber tip 50, whereby a so-called partly detached "hanging" tip 52 would arise, which could lose contact with the yarn 8. The risk of this happening is particularly great when the yarn withdrawal speed is very high. A hanging tip 52 leads usually to an end break.

Figure 5:
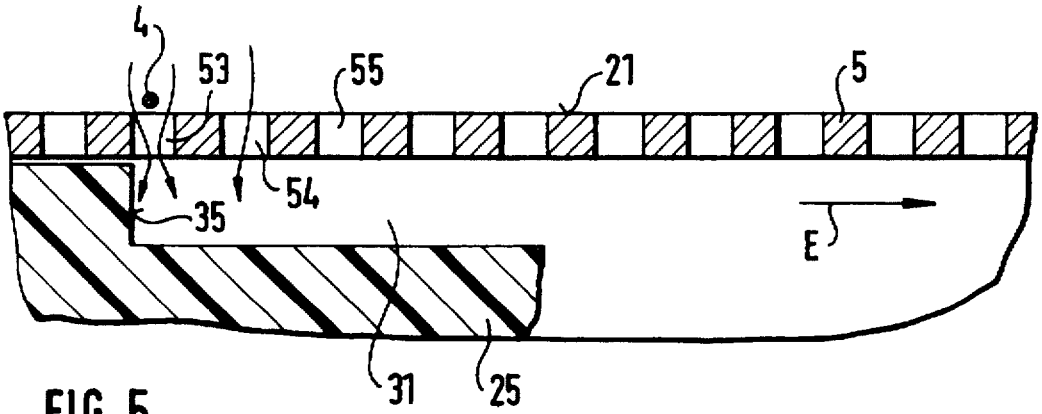
FIG. 5 is an enlarged section representation of the sleeve of a suction roller in a first position in relation to the suction insert.
Figure 6:
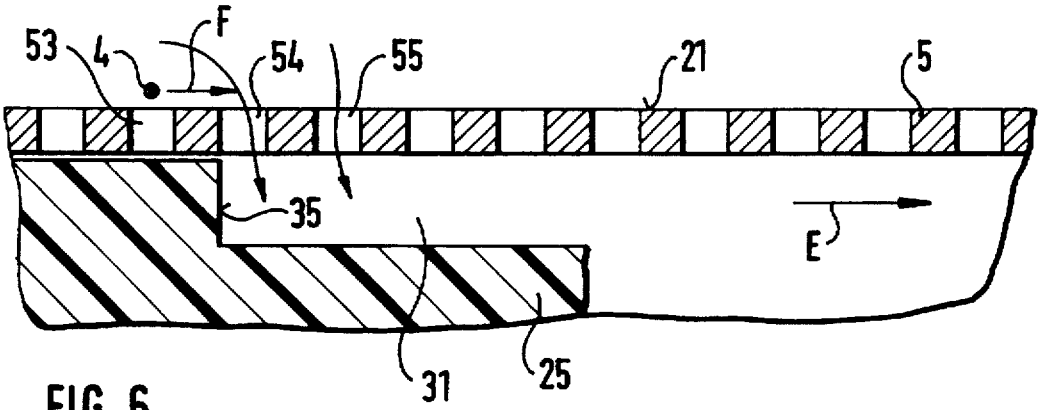
FIG. 6 is a view similar to FIG. 5, showing the suction roller in a second successive position relative to the suction insert.
Figure 7:
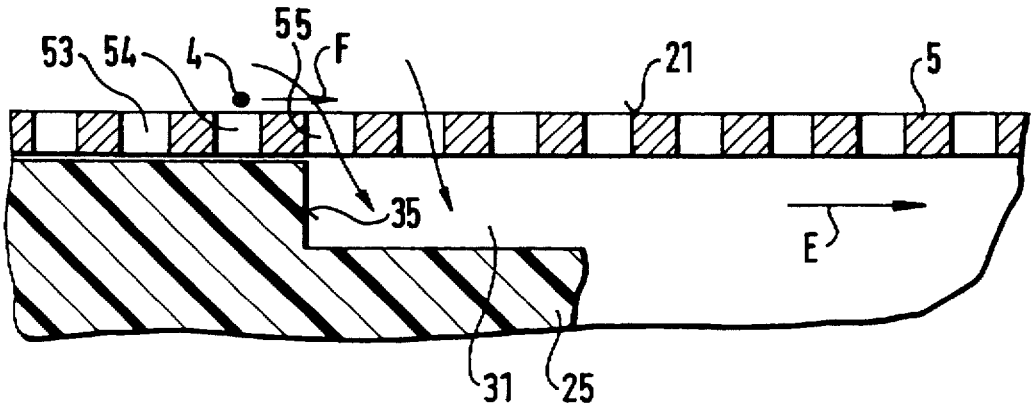
FIG. 7 is a view similar to FIG. 5, showing the suction roller in a third successive position relative to the suction insert.

The schematic drawings in FIGS. 5 to 7 deal with the mechanism of the lateral sliding of the single fibers 4 attached to the circumferential surface 21 of the suction roller 5. Arrow direction F denotes the direction of travel of a single fiber 4.

According to FIG. 5, it is presumed that the lateral defining edge 35—a good distance away before reaching the yarn formation line 6—holds a position in which a certain suction bore hole 53 is still suctioned. A model single fiber 4 remains thus in its position over the suction bore hole 53. Two adjacent suction bore holes in withdrawal direction E are denoted by the references 54 and 55.

According to FIG. 6, the defining edge 35 has neared the yarn formation line 6 somewhat, whereby the defining edge 35 is extended in withdrawal direction E. The suction bore hole 53, exposed in the previous FIG. 5, is not suctioned anymore in the instant shown in FIG. 6, so that the single fiber 4 is forced to deposit itself in the adjacent suction bore hole 54 by means of the air flowing therein. Accordingly, in even closer proximity of the defining edge 35 to the yarn formation line 6 as shown in FIG. 7, a further dislocation of the single fiber 4 in the direction of the suction bore hole 55 takes place. This directional change of a single fiber 4 can be aided in that, when as in FIG. 2 the suction bore holes 22, that is also the suction bore holes 53,54 and 55 are arranged somewhat inclined in withdrawal direction E.

In each of the following FIGS. 8 to 13, suction inserts 25 with differently formed suction areas 31 are described. The contours of each of the suction areas 31 are denoted by a dot-dash line.

Figure 8:
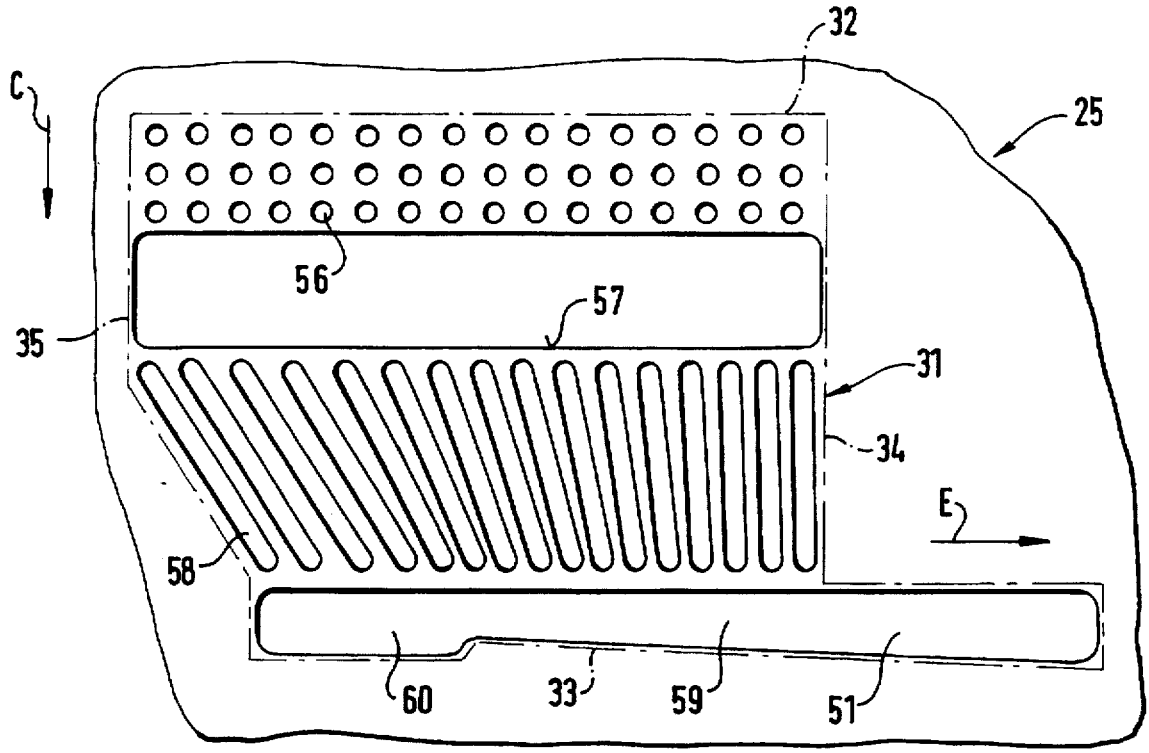
FIGS. 8 to 13 are schematic views of various contours of the suction area of the suction insert, construct ed according to preferred embodiments of the invention.

FIG. 8 shows the respective recesses of a suction insert 25, which is suctioned by the suction opening 24 (see FIG. 1) of the suction tube 23. The defining edges 32 and 33 determine the length of the transport path on the circumferential surface 21 of the suction roller 5, while the defining edges 34 and 35 determine the width of the fiber veil 30 along this transport path.

The area of the fiber beard 15, which is still partly located in the combing structure 17 of the opening roller 3, is suctioned relatively little, so that the suction insert 25 in this area is provided only with a perforation 56, which does not generate a very high amount of air-flow. In contrast, the end of the fiber beard 15 appearing on the circumferential surface 21 receives a strong suction, as here some of the single fibers 4 have already been released from the opening roller 3. For this reason, the suction insert 25 has at this point an open area 57 along the entire width of the fiber veil 30. There are no air brakes present here. The real transport area is arranged downstream. Here a plurality of narrow windows 58, which determine the respective width and direction of the fiber veil 30, are sufficient. These windows 58 are inclined somewhat in withdrawal direction E, namely with the aim of shortening the fiber tip 50 as described above.

Again at the yarn formation line 6 there is a continuous longitudinal slit 59, which has a widened section 60 in the area of the fiber tip 50. As a result of this, the fiber tip 50 is suctioned more strongly, which increases the effect of the windows 58 in tightening the fiber tip 50.

As can be seen, the size of the angle $\alpha$ in withdrawal direction E decreases gradually, as the yarn 8 has, at the end of the fiber veil 30, a diameter of such proportions that the risk of the fiber tip 50, becoming partly detached no longer exists.

Figure 9:
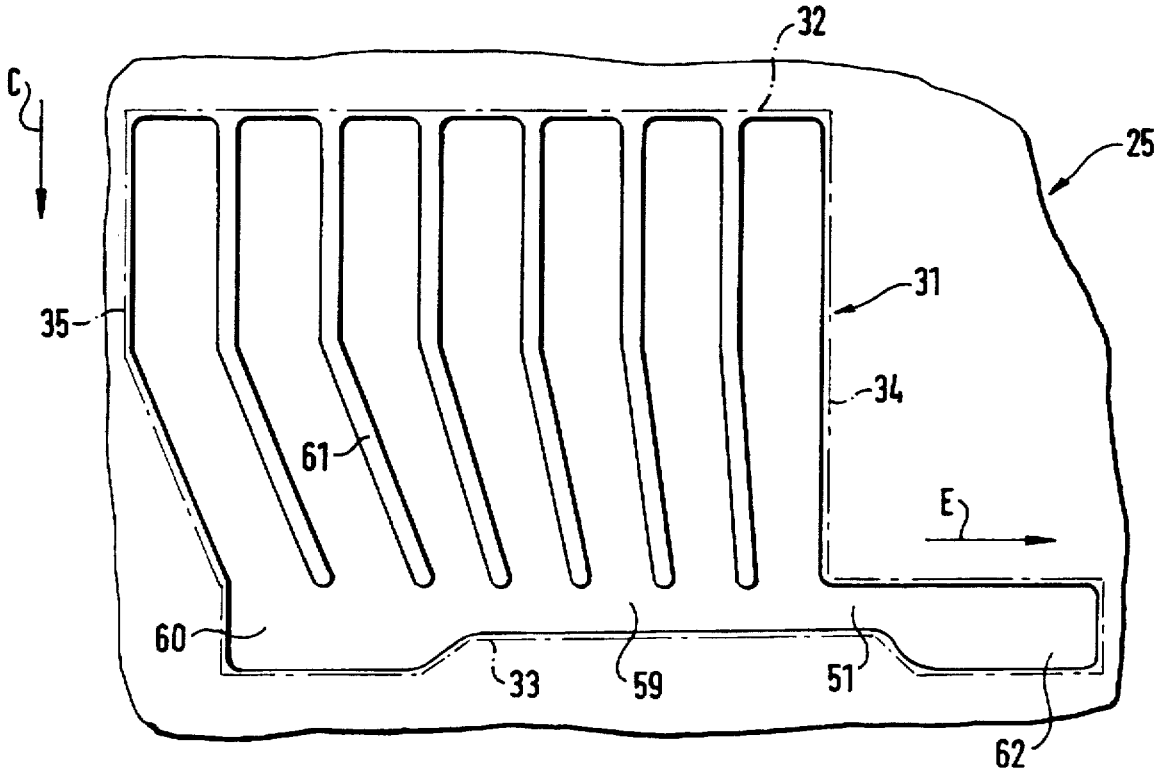

In the embodiment according to FIG. 9, the suction insert 25 is formed with a continuous opening, which is however divided by air guiding ridges 61. The function of these air guiding ridges 61 is to ensure that the circumferential surface 21 is evenly suctioned, preventing any damaging cross flows. With the combined inclination of the air guiding ridges 61 and the inclination of the defining edge 35, the single fibers 4 are deflected somewhat in withdrawal direction E, so that here also a blunted fiber tip 50 arises.

As can be seen from FIG. 9, the extended suction area 51 is provided with a widened area 62, similar to the widened area 60 in the area of the fiber tip 50. This is favorable for twisting the yarn 8.

Figure 10:
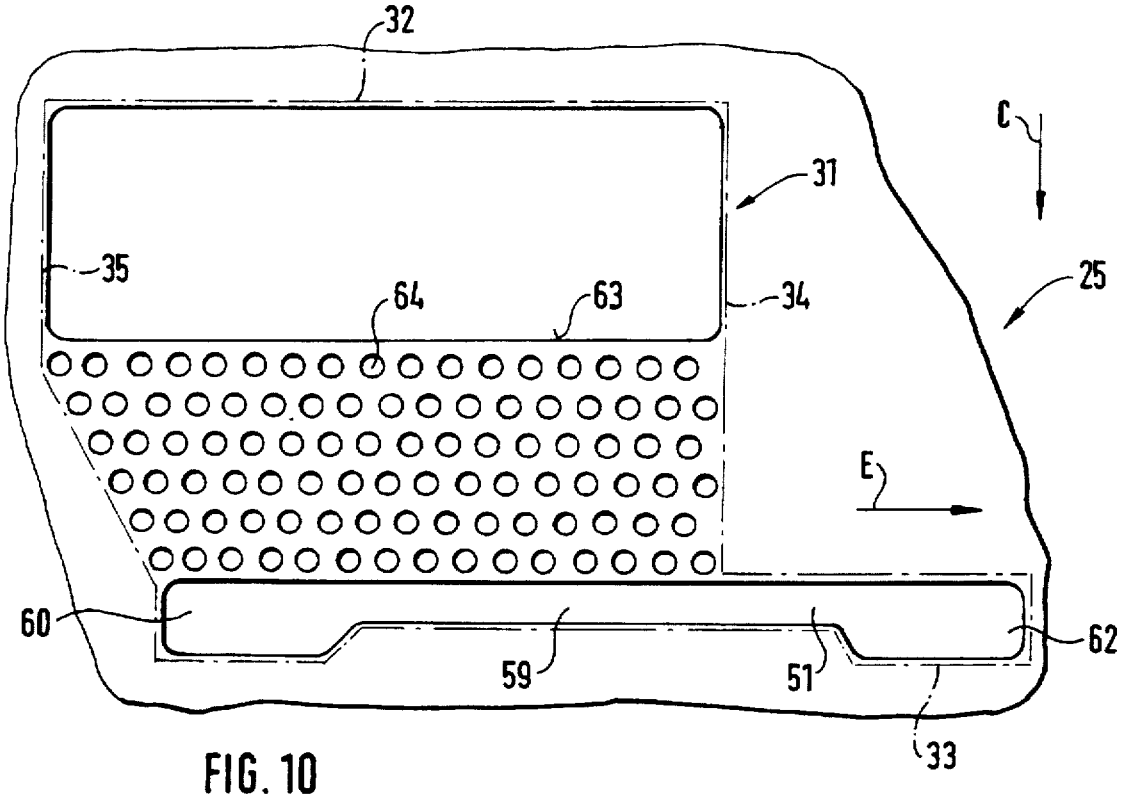

In the embodiment in FIG. 10 a suction insert 25 is provided whose suction area 31 is provided with an open area 63 in the entire area of the fiber beard 15. The actual transport path is provided with a perforation 64, whose defining edge 35 facing the fiber tip 50 is inclined with the aim of shortening the fiber tip 50, namely by inclining the rows forming the perforation 64.

Reference numbers, which are not described here or in the following Figures, refer to structures which have the same function as structures identified above with similar reference numbers.

Figure 11:
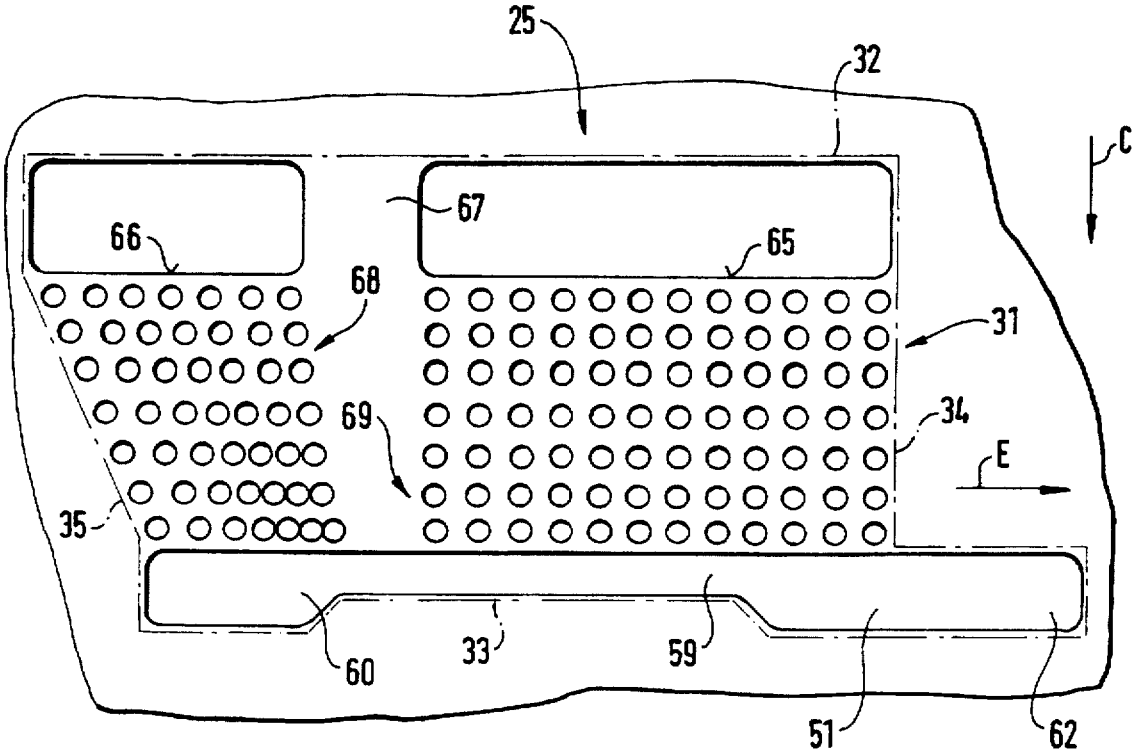

A suction insert 25 according to FIG. 11 is then practical when a plurality of slivers 2 are fed. In the area of the fiber beard 15, a larger open area 65 is provided, which corresponds to the width of, for example, three slivers 2, and a smaller open area 66 is provided which corresponds to the width, for example, of two slivers 2. As, in this case, there is a short distance between two slivers 2, a small suction break 67 is provided between the open areas 65 and 66. As a result of this, the fiber veil 30 also has a small break in its center up to the yarn formation line 6. This is not disadvantageous for the formation of the yarn 8, as the yarn formation is so far completed adjacent to the fiber tip 50 that a partial detaching is no longer a risk.

Adjacent to the open areas 65 and 66 along the transport path are two perforation fields 68 and 69, whose widths are determined by the defining edges 34 and 35. The suction bore holes of the perforation field 68 are inclined at the said angle $\alpha$ against the circumferential direction C of the suction roller 5 to such a degree, that the fiber tip 50 becomes somewhat blunted and tightened.

Figure 12:
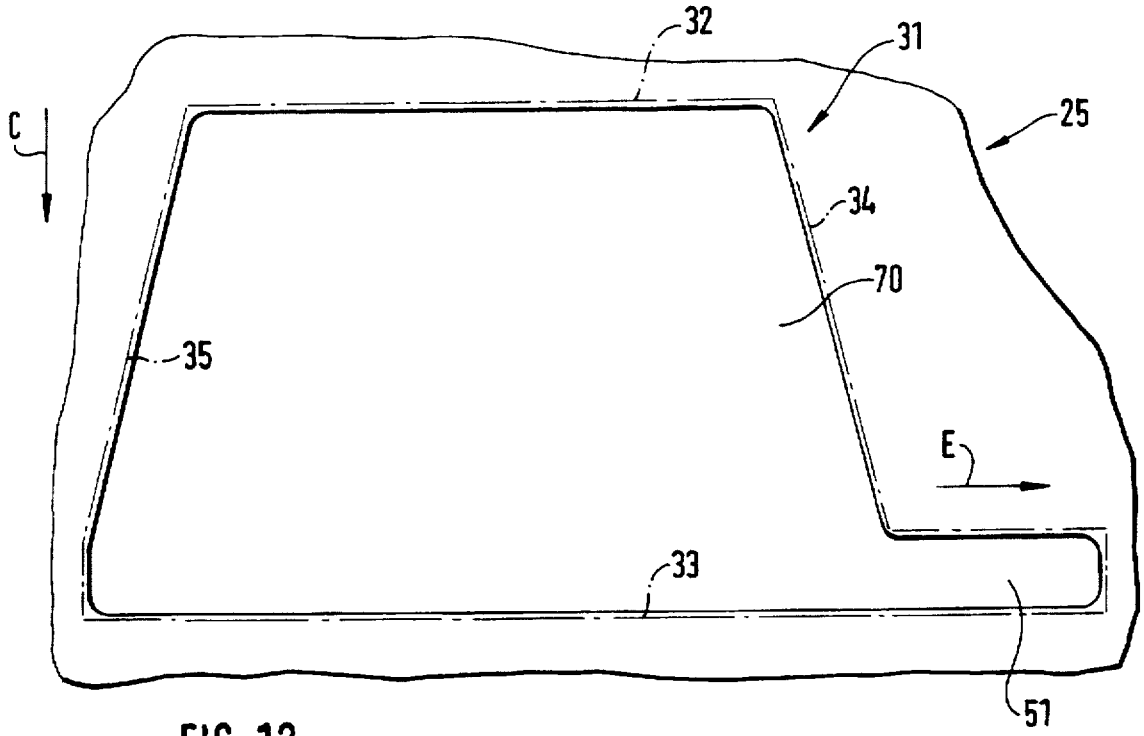

As shown in FIG. 12, a large single opening 70 is provided for the suction area 31 of the suction insert 25.

Differing from the embodiments described up to this point, the lateral defining edges 34 and 35, which define the width of the fiber veil 30, extend away from each other towards the yarn formation line 6. This is in particular necessary when the entire width of the fed slivers 2 is smaller than the width required for the creation of a laterally open fiber formation of the fiber veil 30. The defining edges 34 and 35 then have to ensure that the fiber veil 30 widens to such an extent towards the yarn formation line 6 that single fibers 4 with open ends arise.

Practice has shown that the fiber veil 30 should be at least 70 mm when it arrives at the yarn formation line 6. Otherwise there would be a risk that the single fibers 4 could come into contact with each other and the twist generated at the yarn formation line 6 could expand in opposite direction to the transport path.

A large single opening 70 does not, of course, have to be provided; the same auxiliary components as described above can in principle be used also in the embodiment according to FIG. 12, that is the arranging of correspondingly inclined windows or air guiding ridges.

Figure 13:
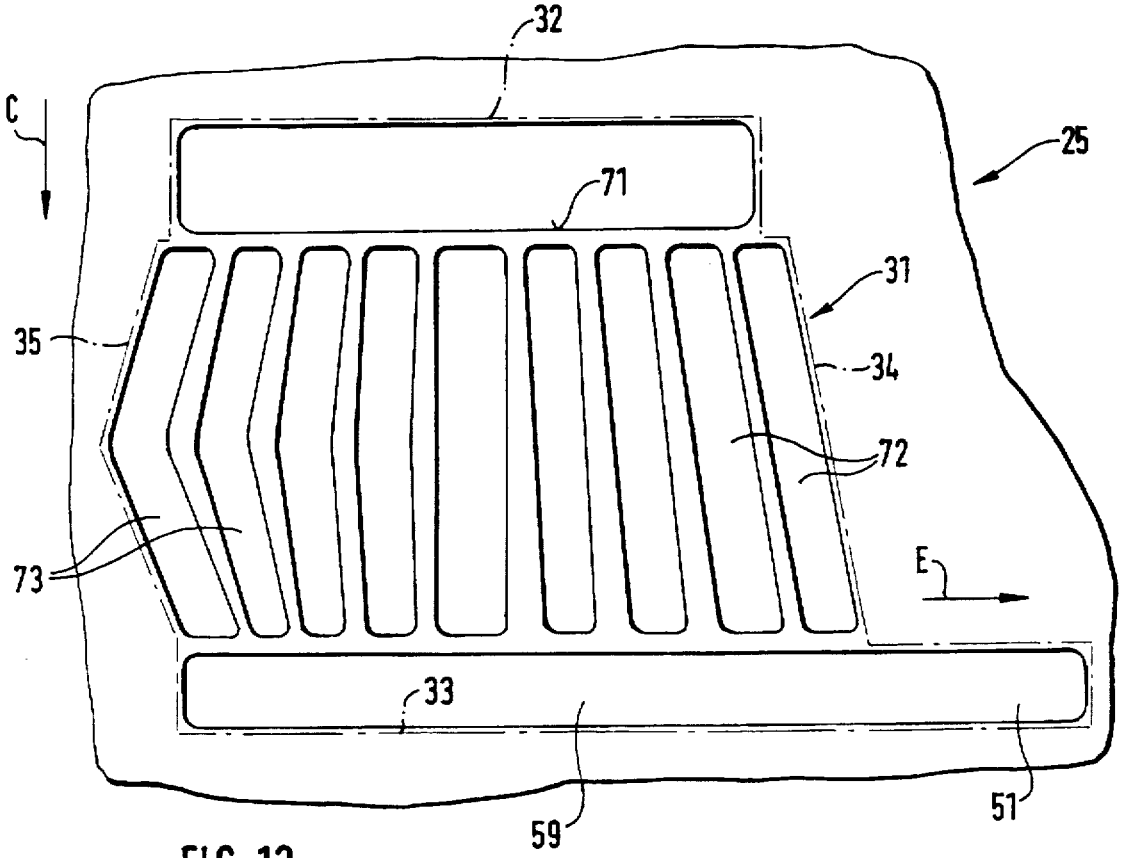

In the embodiment in FIG. 13, there is a combination or the features shown in FIG. 12 and FIGS. 8 to 11. The fiber veil 30 is widened on the first part of the transport path to such an extent that a sufficient lateral widening to single fibers 4 arises, while towards the yarn formation line 6 in the area of the fiber tip 50 the lateral defining edge 35 is inclined against circumferential direction C with the aim of blunting the fiber tip 50. For this reason, on its side facing the fiber tip 50, the defining edge 35 is provided with a bend.

The suction area 31 begins in the area of the fiber beard 15 having a large open area 71 and graduates then into windows 72 or bent windows 73, which are accordingly inclined to the desired degree. The single fibers 4 arriving in the area of the fiber tip 50 are thus tightened somewhat in withdrawal direction E, after having previously been spread, while at the other defining edge 34 the fiber veil 30 is continuously widened, until the single fibers 4 are sufficiently laterally drawn apart.

The present invention was described with the aid of a suction roller 5 arranged downstream of an opening roller 3. Alternatively, however, the functions of the opening roller 3 and the suction roller 5 can be united in one single suction roller.

There would then be a pneumatic opening of the sliver 2 to single fibers 4 using a suctioned opening roller essentially free of combing means, which would also serve to transport the fibers. A suction roller of this type also comes under the scope of the present invention.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A suction roller for an open-end spinning machine for transporting a fiber veil along a transport path which extends between a fiber incoming position on the circumference on the suction roller to a yarn formation line extending transversely of the circumference of the suction roller and disposed downstream of and circumferentially spaced from the fiber incoming position with said fiber veil expanding transversely of the suction roller and consisting of fibers extending in the circumferential direction of the suction roller, said suction roller comprising a suction insert with defining edges defining a suction area which determines the circumferential length and width of the fiber veil along the transport path during use of the suction roller to transport the fiber veil, wherein one of the defining edges which is on a side of the fiber veil further away from a withdrawal device for withdrawing the yarn from the suction roller extends at least along a section of the transport path at an acute angle with respect to the circumferential direction of the suction roller.

2. A suction roller according to claim 1, wherein the defining edges, which define the width of the fiber veil, increase their distance from one another at least along a section of the transport path.

3. A suction roller according to claim 2, wherein the suction area between the defining edges, which define the width of the fiber veil, is divided by air guiding ridges.

4. A suction roller according to claim 2, wherein the suction area is longer along the yarn formation line than corresponds to the width of the suction area defining the width of the fiber veil.

5. A suction roller according to claim 1, wherein said one defining edges, extends at the acute angle in the circumferential direction in the area of the yarn formation line to thereby shorten the yarn formation line as compared to a corresponding defining edge extending in the circumferential direction.

6. A suction roller according to claim 5, wherein the suction area between the defining edges, which define the width of the fiber veil, is divided by air guiding ridges.

7. A suction roller according to claim 6, wherein the angle of inclination of the air guiding ridges varies over the width of the suction area defining the width of the fiber veil.

8. A suction roller according to claim 1, wherein the suction area between the defining edges, which define the width of the fiber veil, is divided by air guiding ridges.

9. A suction roller according to claim 8, wherein the angle of inclination of the air guiding ridges varies over the width of the suction area defining the width of the fiber veil.

10. A suction roller according to claim 9, wherein the suction area is longer along the yarn formation line than corresponds to the width of the suction area defining the width of the fiber veil.

11. A suction roller according to claim 8, wherein the suction area is longer along the yarn formation line than corresponds to the width of the suction area defining the width of the fiber veil.

12. A suction roller according to claim 1, wherein the suction area is longer along the yarn formation line than corresponds to the width of the suction area defining the width of the fiber veil.

13. Suction roller assembly for an open-end spinning machine for transporting a fiber veil along a transport path which extends between a fiber incoming position on the circumference of the suction roller to a yarn formation line extending transversely of the circumference of the suction roller and disposed downstream of and circumferentially spaced from the fiber incoming position with said fiber veil extending transversely of the suction roller and consisting of fibers extending in the circumferential direction of the suction roller, comprising:

a hollow perforated suction roller, and a suction control insert disposed inside said suction roller operable to control suction forces acting on a fiber veil transported along the transport path on a surface of said suction roller with at least changing in the width of the fiber veil along the circumferential length of the transport path along an edge further away from a withdrawal device for withdrawing the yarn from the suction roller.

14. A suction roller assembly according to claim 13, wherein said suction control insert includes defining edge structure delimiting the transport path sections to thereby change the width of the fiber veil along the circumferential length of the transport path.

15. A suction roller assembly according to claim 14, wherein the defining edge structure includes defining edges which delimit the width of the fiber veil in a direction parallel to a rotational axis of the suction roller.

16. A suction roller assembly according to claim 15, wherein said suction roller includes a variable suction operative pattern along the length of the suction roller.

17. A suction roller assembly according to claim 15, wherein said control insert includes suction slots which are inclined with respect to a circumferential direction of the suction roller.

18. A suction roller assembly according to claim 14, wherein said defining edges are configured to narrow the width of the fiber veil in a direction toward the yarn formation line.

19. A suction roller assembly according to claim 18, wherein said defining edge at a yarn withdrawal end of said suction control insert is configured to increase the width of effective suction area at said yarn withdrawal end.

20. A suction roller assembly according to claim 14, wherein said suction roller includes a variable suction operative pattern along the length of the suction roller.

21. A suction roller assembly according to claim 14, wherein said control insert includes suction slots which are inclined with respect to a circumferential direction of the suction roller.

22. A suction roller assembly according to claim 13, wherein said suction roller includes a variable suction operative pattern along the length of the suction roller.

* * * * *